United States Patent [19]

Johnson

[11] Patent Number: 4,930,396

[45] Date of Patent: Jun. 5, 1990

[54] GUN MUZZLE BRAKE

[76] Inventor: Sam E. Johnson, 1519 Westbury Dr., Davison, Mich. 48423

[21] Appl. No.: 366,877

[22] Filed: Jun. 15, 1989

[51] Int. Cl.[5] ..... F41C 21/18
[52] U.S. Cl. ..... 89/14.3
[58] Field of Search ..... 89/14.3

[56] References Cited

U.S. PATENT DOCUMENTS

| | | | |
|---|---|---|---|
| D. 285,238 | 8/1986 | Cellini | 89/14.3 |
| 785,973 | 3/1905 | McClean | 89/14.3 |
| 817,134 | 4/1906 | Smith | 89/14.3 |
| 2,212,686 | 8/1940 | Hughes | 89/14.3 |
| 2,765,706 | 10/1956 | Strohl | 89/14.3 |
| 3,115,060 | 12/1963 | Ashbrook et al. | 89/14.3 |
| 3,138,991 | 6/1964 | Malter | 89/14.3 |
| 3,141,376 | 7/1964 | Chinn | 89/14.3 |
| 3,367,055 | 2/1968 | Powell | 89/14.3 |

FOREIGN PATENT DOCUMENTS

| | | | |
|---|---|---|---|
| 657091 | 5/1929 | France | 89/14.3 |

*Primary Examiner*—Charles T. Jordan
*Assistant Examiner*—Michael J. Carone
*Attorney, Agent, or Firm*—Krass & Young

[57] ABSTRACT

The invention is an improved muzzle brake with the outer appearance of a perforated metal cylinder and an inner chamber composed of cylindrical sections, tapering sections, conical sections, and abrupt and gradual changes between the various sections. The brake is intended to be attached to the muzzle of a gun such as a rifle, pistol or shotgun. Holes running radially from the surface of the brake into the inner chamber divert a portion of the propelling gases away from the normal direction of such gases, resulting in a reduction in recoil. The holes are spaced about the surface of the brake along spirals. The use of many small regularly patterned holes results in a decrease in the perceived discharge noise.

14 Claims, 2 Drawing Sheets

GUN MUZZLE BRAKE

FIELD OF THE INVENTION

The invention relates to devices for reducing the apparent recoil of a conventional projectile firing weapon, such as a rifle, pistol or shotgun, and more particularly, to an improvement in muzzle brakes.

BACKGROUND OF THE INVENTION

It is well known that projectile firing weapons, such as rifles, pistols, and shotguns generate a substantial recoil. The force exerted by the weapon against the body of a shooter, or against the structure supporting the weapon is proportional to the mass and velocity of the projectile. It is also proportional to the mass and type of propellant and inversely proportional to the mass of the weapon. For an individual firing a small caliber weapon, the recoil forces are manageable. A .22 caliber firearm, utilizing a relatively small charge of powder, generates forces which even a small child can anticipate and accommodate if properly trained. However, for larger caliber weapons, which utilize large powder charges, the recoil forces are substantially larger. They can result in great discomfort to the person firing the weapon and, in extreme cases, can cause personal injury.

A desirable object is to control or limit the recoil generated by such weapons. It has long been known that the undesirable recoil characteristics of firearms can be diminished by the use of a muzzle gas dispersing device, commonly known as a muzzle brake. By diverting a portion of the hot muzzle gases to a direction different than that of the bore of the gun barrel, the recoil forces are reduced. However, substantial room for improvement in the reduction of recoil utilizing this method may yet be realized by improved technologies.

Muzzle brakes currently in use have substantial undesirable side effects. Such muzzle brakes cause a significant increase in the amount of perceived noise generated by the discharge of the weapon. This is due, in large measure, to the use of relatively few openings or diverters having relatively large areas. Commonly, two to four identical large backward leaning slots are cut into the top of a barrel's muzzle or an attached muzzle brake in an irregular pattern. Such diverters remove hot gasses rapidly and thereby shift the sonic energy to frequencies that are undesirable, cause muzzle blast, and concentrate sonic energy near specific frequencies. A need exists in the art for a muzzle brake that meters the escaping gasses so they are removed more slowly.

SUMMARY OF THE INVENTION

It is the object of this invention to provide a novel and improved gun muzzle brake that significantly reduces recoil of the gun without appreciatively increasing relative noise levels.

In accordance with the present invention, the improved gun muzzle brake is formed in the barrel or in a removable steel cylindrical body having properties similar to those of the steel used to make gun barrels. This muzzle brake has a longitudinal chamber including various sections, and the whole muzzle brake is pierced by a large number of small openings. These openings are preferably angled forward. The various sections of the chamber are coaxial with each other and with the bore of the gun. Further, they do not interfere with the passage of the bullet. Two special types of sections are:

(a) The "gas slip" formed as a truncated cone allowing expansion of the propellant gases. The gas slip could alternatively be a cylindrical section of increased diameter. The gas slip is pierced by a number of openings.

(b) The thrusting shoulder having an abrupt narrowing of the chamber in a direction away from the muzzle of the gun thus forming an annular shoulder. The thrusting shoulder also has a number of openings.

The expectation is that a thrusting shoulder and a gas slip are particularly effective in facilitating the dispersing of the propelling gases. The preferred embodiment has a section closest to the muzzle of the gun that is significantly larger in cross section than the bore of the gun and contains at least one gas slip. This wide section is followed by a thrusting shoulder or a tapered narrowing section and then a relatively long narrow section slightly larger in diameter than the bore of the gun. The narrow section ends at the front of the muzzle brake. An additional gas slip is included a short distance inside of the front of the narrow section.

This muzzle brake is an improvement over prior muzzle brakes in that the numerous small openings modify the acoustical intensity versus pitch distribution of the noise. Thus, the perceived noise is very small and no greater than that of a gun without a muzzle brake.

The sonic energy is then neither shifted to undesirable pitches nor concentrated near specific undesirable frequencies.

Comparing the discharge of the same gun with and without the use of the present invention reveals a significant reduction in the amount of recoil, without appreciably increasing the measured and perceived noise.

The present invention is also advantageous as compared to other muzzle brakes on the same gun, because the measured discharge noise and perceived noise are lower when using the present invention.

The present invention is further advantageous in that the small openings of the present invention resist collection of the debris typically encountered in the field.

DESCRIPTION OF THE PREFERRED EMBODIMENT

The invention operates to divert propelling gas in a direction other than the direction of the bore. The diameter of the first interior chamber of the muzzle brake immediately following the bore is greater than the bore. This increased dimension allows for expansion of the propelling gas. Thereafter, the chamber decreases in diameter, which tends to compress the gas. However, a plurality of relatively small openings located adjacent to the diameter decrease in this narrowed section allows the gas to escape in a direction other than the bore. Thus, with a series of decreasing diameters and small openings portions of the gases are progressively metered and diverted in a series of steps without increasing the sonic energy. This rapid, step-wise diameter decreases serve to channel portions of the gas through specific openings to a direction other than along the bore axis.

Figure 1:
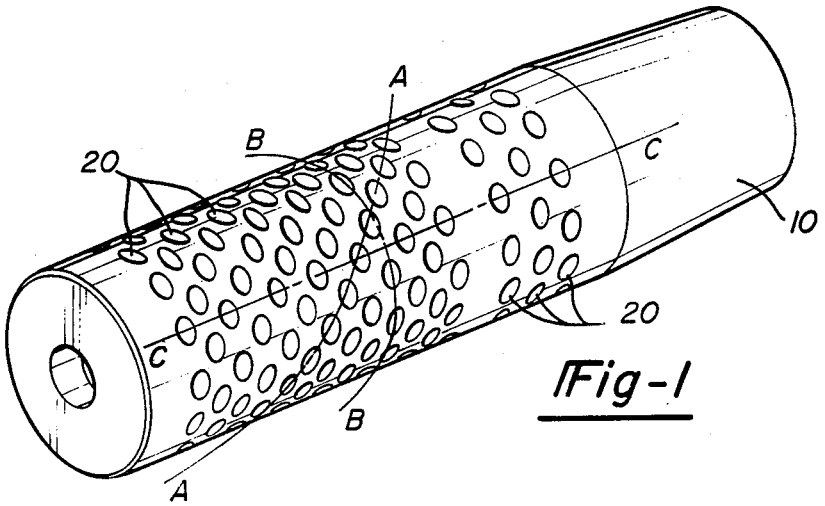
FIG. 1 is a perspective side view of the invention, showing the body and selected openings.

On FIG. 1 is shown the external appearance of the preferred embodiment of the invention as a removable body. The external appearance is that of a cylindrical body 10 pierced by numerous small circular openings 20. The body 10 is composed of a steel having properties of hardness, ability to be polished, and ability to be blued, Parkerized, nickel plated, or finished similar to the steel used in making the barrel to which the muzzle brake is attached. The outside diameter of the body 10 is somewhat larger than the outside diameter of the associated barrel.

Figure 4:
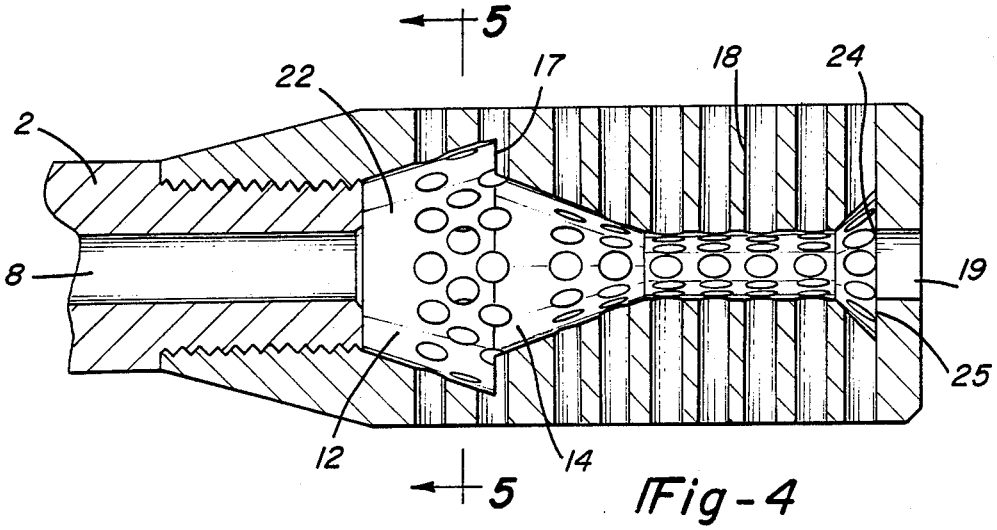
FIG. 4 is a cross section of a further simplified embodiment of the invention, affixed to the muzzle of a gun.

The pattern of openings 20 has one blank or missing band corresponding roughly to the widest part of the diverter cone 14 (FIG. 4). Typically, there are three bands of fifteen openings 20 into first section 12, followed by the blank or missing band, and continuing with thirteen bands of fifteen openings 20.

The number of openings varies somewhat with the outside diameter of the body, with no fewer than one hundred eighty (180) openings 20 used and roughly two hundred (100) openings 20 being typical. The openings 20 have a diameter of no more than 0.125 inches. These small openings 20 do not allow foreign matter to readily lodge therein.

The openings 20 are spaced along the surface of a body 10 in a series of regular spiral patterns inclined essentially 45 degrees from the bore axis of the body 10 (such as along dotted line A). For each particular opening 20, each of its nearest openings 20 lie along line segments extending essentially 45°, 135°, 225°, or 315° (relative to the longitudinal bore axis of the body 10) from the center of the particular opening 20. The pattern of openings 20 immediately surrounding and including a particular opening 20 looks very much like the five dots on the value five side of a common game die. The pattern of openings 20 may also be described as being one of equally spaced openings 20 lying on a series of regularly spaced bands circumscribing the body 10 where the openings 20 on adjacent bands are all rotated with respect to each other essentially one half of the spacing between openings 20. (Such as along dotted line B.) Alternatively, one may describe the pattern of openings 20 as being one of openings 20 lying along straight rows essentially parallel to the axis of the body 10 (such as along dotted line C).

FIG. 4 illustrates a cross section of a first embodiment of the invention affixed to the muzzle end of the barrel 2. The muzzle brake is affixed to barrel 2 by mating barrel threads 6 cut into the outside of the barrel 2 and into the inside of the body 10. The threads 6 are thus cut into body 10. Alternatively, mating threads may be cut into the bore 8 and the outside of the body 10.

Interior chamber 22 freely communicates with openings 20 and is composed of several coaxial sections of differing diameters and tapers. Immediately forward of the barrel 2, first gas slip section 12 allows for expansion of the propelling gas. The diameter of gas slip section 12 tapers to a diameter significantly greater than that of the bore 8 as it proceeds away from barrel 2. First thrusting shoulder 17 abruptly narrows the interior chamber 22 between gas slip 12 and diverter cone 14. Thrusting shoulder 17 forces a significant portion of the propelling gas away from the axis of the bore 8 through a plurality of openings 20. More specifically, a radial series of openings 20 (such as along line B in FIG. 1) intersects the thrusting shoulder 17 to maximize the available outlet area for the thrusting shoulder 17.

Diverter cone 14 appears as a truncated cone with its widest diameter most distant from the muzzle end of the muzzle brake and decreases the diameter of interior chamber 22 and further force propelling gases into openings 20. Although it does not possess an abrupt narrowing, the diverter cone 14 constricts and forces the gas to further be diverted through openings 20. Cylindrical section 18 roughly corresponds to the bore 8 diameter. Cylindrical section 18 roughly corresponds to the bore 8 diameter. Cylindrical section 18 communicates with a number of openings 20 and does allow for the diversion of the gas.

Toward the muzzle end 19 of the muzzle brake, an additional gas slip 24 and thrusting shoulder 25 allow for final diversion of the gas. Again, the preferred embodiment provides for a radial series of openings 20 to intersect the thrusting shoulder 25. However, since the diagrams show a reduced number of openings 20 for clarity, the intersection of the openings 20 by a thrusting shoulder is not always depicted. Forward gas slip 24 and thrusting shoulder 25 function similarily to the previously described arrangement. They are typically machined into the muzzle brake from the muzzle end using conventional means.

Figure 3:
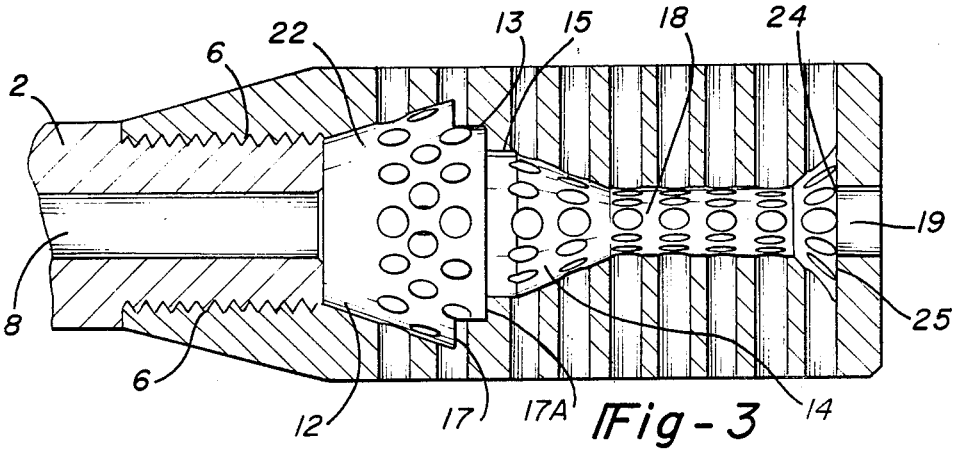
FIG. 3 is a cross section of a simplified embodiment of the invention, affixed to the muzzle of a gun.

With reference now to a second embodiment disclosed in FIG. 3, the first gas slip 12 is followed by more than one thrusting shoulder. FIG. 3 illustrates first thrusting shoulder 17 as previously described. A first cylindrical section 13 follows thrusting shoulder 17. Thereafter, an additional thrusting shoulder 17A and second cylindrical section 15 follow. Diverter cone 14 follows. This forms a series of thrusting shoulders which meter and deflect the propelling gas.

The diverter cone 14 tapers from the diameter of the second cylindrical section 15 to the diameter of the cylindrical section 18. The diameter of cylindrical section 18 remains slightly greater than that of the bore 8.

Figure 2:
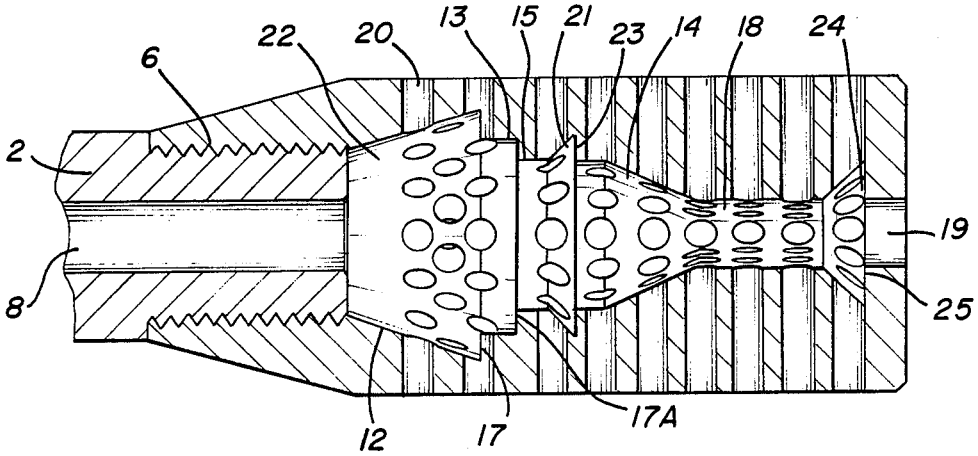
FIG. 2 is a cross section of the preferred embodiment of the invention, affixed to the muzzle of a gun.

FIG. 2 illustrates a third embodiment designed to maximize deflection of propelling gas which contains at least one additional gas slip 21. Gas slip 21 is cut into the second cylindrical section 15 and is followed by an additional thrusting shoulder 23 to form yet another annular deflecting surface.

It is anticipated that the present invention would be machined into the muzzle end of barrel 2 using conventional techniques.

The ultimate goal of the invention is deflection of propelling gases by the progression of shoulder sections. The initial gas slip is used to reach a maximum diameter for the first shoulder section. Multiple shoulders can then progress in a stepwise fashion through smaller diameters. Should additional shoulders be necessary, the working diameter of chamber 22 is increased by an additional truncated cone, such as gas slip 21, and the progression continues to the muzzle 19. Thus, an infinite variety of slip/shoulder combinations are possible.

An alternative embodiment may be effected by the use of sections that are essentially in the shape of a cylinders of the largest diameter of each gas slip, in place of the gas slip 12. A cylinder would similarily allow for the expansion of propelling gases.

Figure 5:
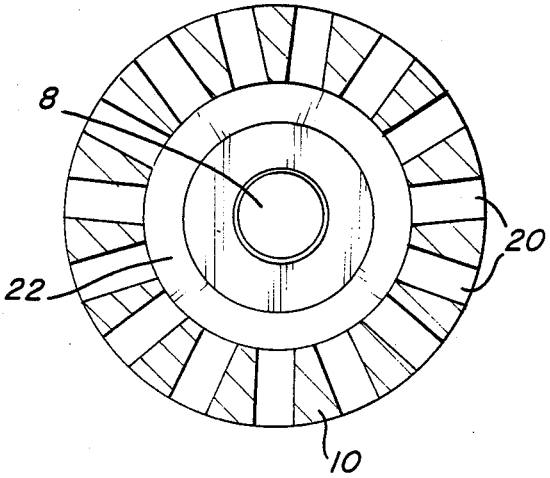
FIG. 5 is a cylindrical cross section of the invention.

FIG. 5 is a cross section of the invention normal to the chamber 22 along the lines 5—5 of FIG. 4. FIG. 5 illustrates the openings 20 communicating radially from the chamber 22 to the outside of the body 10. The bore 8 is seen central to the drawing.

Figure 6:
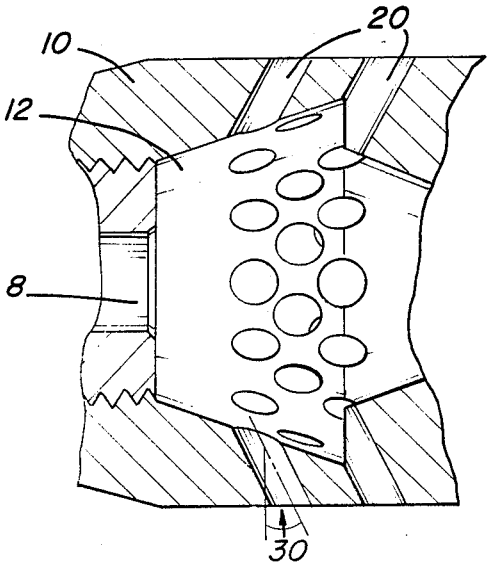
FIG. 6 is a detailed and close-up view of a section of FIG. 2.

FIG. 6 illustrates a further feature of the invention. The openings 20 are angled forward from the perpendicular to the bore axis. Preferably this angle 30 is in the range of three to fifteen degrees forward from a position perpendicular to the bore axis. This increases the ability of the thrusting shoulder 17 and gas slip 12 to deflect the propelling gas.

As the propelling gas leaves the barrel 2 it tends to expand into any available space. This factor alone tends to force the gas out of openings 20. To amplify this tendency, an area of increased diameter is followed by an abruptly narrowing annular shoulder, such as thrusting shoulder 17. This provides a wall which deflects a portion of the gas out of the intersected openings 20. Each of these shoulders divert a significant portion of the gas. Further, converging diameters, such as of the diverter cone 14, function to further divert the gas. The gas will oppose compression and be diverted out the related openings 20.

Overall, the propelling gas is metered through all the openings 20 of the muzzle brake, instead of being diverted by a relatively few such openings. This effectively diffuses the recoil energy, but does not increase or concentrate the sonic energy.

The invention is manufactured using conventional machining techniques. These techniques include matching, drilling, heat treating to impart hardness, steel shot blasting, centerless grinding, polishing, and bluing, Parkerizing, or the use of other coatings or platings.

Although a preferred embodiment of the invention has been disclosed in detail, it will be recognized that variations or modifications lie within the scope of the present invention.

I claim:

1. An improved muzzle brake for a gun barrel having a muzzle end and bore comprising:

a chamber formed inside said muzzle brake coaxial with said bore and freely communicating with a plurality of openings, having:

a first conical section having its widest diameter most distant said muzzle end formed into said chamber proximate said muzzle end;

an annular shoulder being disposed proximate said widest diameter of said first conical section;

a second conical section having its narrowest diameter most distant said muzzle and disposed proximate said annular shoulder; and a cylindrical section disposed proximate said narrowest diameter of said second conical section; and said plurality of openings spaced about the surface of said muzzle brake and extending into said muzzle brake and communicating with said chamber.

2. The invention as recited in claim 1, wherein said widest diameter of said first conical section is significantly larger than the diameter of the bore of the gun barrel.

3. The invention as recited in claim 1, wherein said openings are further angled forward from a position perpendicular to the bore.

4. The invention as recited in claim 1, wherein said plurality of openings comprises at least one hundred openings.

5. The invention as recited in claim 1, wherein said openings have a diameter not exceeding 0.125 inches.

6. The invention as recited in claim 1, wherein said annular shoulder intersects a plurality of said openings.

7. An improved muzzle brake for a gun barrel having a muzzle end and bore comprising:

a chamber formed inside said muzzle brake coaxial with said bore and freely communicating with a plurality of openings, having:

a first conical section having its widest diameter most distant said muzzle end formed into said chamber proximate said muzzle end;

a plurality of annular shoulders being disposed proximate said widest diameter of said first conical section;

a second conical section having its narrowest diameter most distant said muzzle and disposed proximate the annular shoulder of said plurality of annular shoulders disposed proximate said widest diameter of said first conical section which is most distant from said muzzle end; and a cylindrical section disposed proximate said narrowest diameter of said second conical section; and said plurality of openings spaced about the surface of said muzzle brake and extending into said muzzle brake and communicating with said chamber.

8. An improved muzzle brake as recited in claim 7, wherein said muzzle brake is a removable body having attachment means which consists of a mating set of threads cut into the muzzle end of the gun barrel and into said removable body.

9. An improved muzzle brake as recited in claim 7, wherein said openings are spaced about the surface of said body along radial patterns.

10. An improved muzzle brake as recited in claim 7, wherein at least one of said annular shoulders intersects a plurality of said openings.

11. An improved muzzle brake as recited in claim 7, wherein said widest diameter of said first conical section intersects a plurality of said openings.

12. An improved muzzle brake as recited in claim 7, wherein each opening of said plurality of openings is oriented perpendicular to said bore.

13. An improved muzzle brake as recited in claim 7, wherein each opening of said plurality of openings is oriented forwardly canting at a less than perpendicular angle to said bore.

14. An improved muzzle brake for use with a gun barrel having a muzzle end and bore, comprising:

a cylindrical body;

means for securing said body to the muzzle end of said barrel;

a plurality of openings spaced about the surface of said body and extending radially through said body and further being canted forward from a position perpendicular to said bore; and a chamber formed inside said body co-axial with said bore having;

a first conical section having its widest diameter most distant said muzzle formed into said chamber proximate said muzzle;

at least one annular shoulder intersecting a plurality of openings and further being disposed proximate said widest diameter of said first conical section;

a second conical section having its widest diameter most distant said muzzle disposed proximate said first section;

at least one annular shoulder intersecting a plurality of openings, and further disposed proximate said widest diameter of said second conical section;

a third conical section having its widest diameter least distant said muzzle disposed between said second conical section and a cylindrical section of a diameter slightly in excess of said bore; and a fourth conical section having its widest diameter most distant said muzzle disposed on said cylindrical section.

* * * * *